United States Patent [19]

Brockbank et al.

[11] Patent Number: 4,653,444

[45] Date of Patent: Mar. 31, 1987

[54] PUSH-IN MOTOR STARTER AND GLO PLUG IGNITER FOR MODEL AIRPLANES

[76] Inventors: Lucas T. Brockbank, 1718 Randolph Rd., Schenectady, N.Y. 12308; Donald Day, P.O. Box 99, Voorheesville, N.Y. 12186; Robert F. Zukowski, 11 Elm Pl. Apt. 17, Albany, N.Y. 12203

[21] Appl. No.: 750,083

[22] Filed: Oct. 28, 1985

[51] Int. Cl.[4] ..... F02N 11/12

[52] U.S. Cl. ..... 123/179 AS; 123/179 BG; 123/179 C

[58] Field of Search ..... 123/179 B, 179 BG, 179 AS, 123/179 SE, 179 C, 184, 186, 424

[56] References Cited

U.S. PATENT DOCUMENTS

| | | | |
|---|---|---|---|
| 1,771,617 | 7/1930 | Cohee | 123/186 |
| 2,475,750 | 7/1949 | McCormick et al. | 123/179 AS |
| 2,625,143 | 1/1953 | Demitz | 123/179 AS |
| 3,111,785 | 11/1963 | McRoskey et al. | 123/179 AS |
| 3,190,276 | 6/1965 | Diggs | 123/179 SE |
| 4,183,341 | 1/1980 | Eastman | 123/179 B |

*Primary Examiner*—Willis R. Wolfe, Jr.

[57] ABSTRACT

This wiring circuit allows for the use of an electric starting motor to revolve the model engine up to its normal operating R.P.M. range before the glo plug is ignited. This method provides combustion within the engine cylinder at a time when the propeller or flywheel has built up sufficient momentum to provide high enough piston speed to carry over the top dead center point at which combustion occurs, and eliminates the probability of the piston being driven backward causing backfiring or kickback.

1 Claim, 1 Drawing Figure

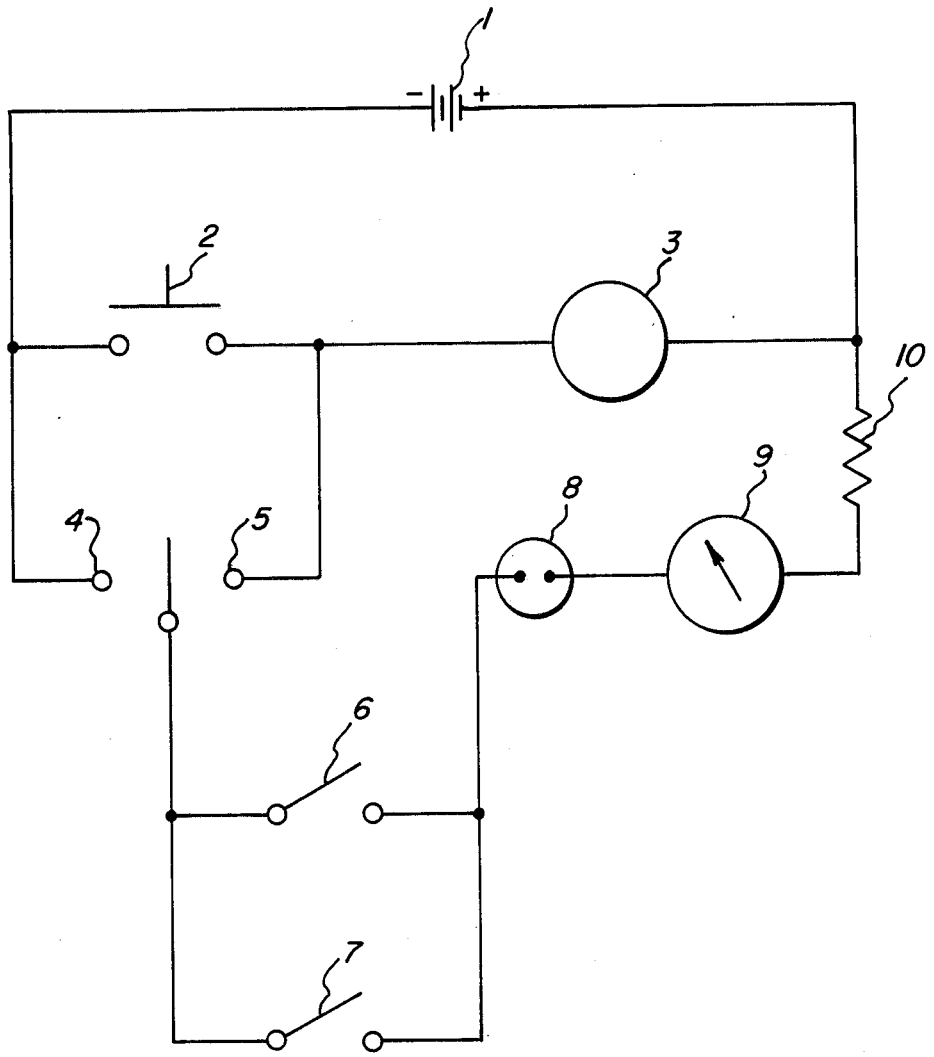
1
-
+
2
3
10
9
8
4
5
6
7

PUSH-IN MOTOR STARTER AND GLO PLUG IGNITER FOR MODEL AIRPLANES

BACKGROUND OF THE INVENTION

This invention relates to a means of providing operator control of the ignition timing in the starting operation of model glo plug engines, for the purpose of preventing kick back, or backfiring, with the resulting danger of propellers or flywheels being thrown off.

DESCRIPTION OF THE PRIOR ART

Unlike spark ignition systems, the glo plug ignition system, as provided on model engines, has no provision for the retarding, varying, or control of the ignition timing.

Because of the inability to retard ignition timing during the engine starting process, and the practice of providing power to the glo plug before cranking, or starting the motor, backfiring frequently occurs.

Backfiring creates not only a danger to the operator from thrown propellers and flywheels, but often leads to extensive damage to the engine itself.

SUMMARY OF THE INVENTION

Within the accompanying electrical schematic which is the basis of this invention, we have shown a series of electrical components encompassing a starting motor circuit, and a glo plug ignition circuit, that will provide operator control over a sequence of events in the starting operation of model glo plug engines. This sequence reverses the standard starting procedure, and eliminates the probability of backfiring problems with the associated danger involved.

BRIEF DESCRIPTION OF THE DRAWING

FIG. No. 1 represents the wiring diagram and the electrical components involved.

DESCRIPTION OF THE PREFERRED EMBODIMENT

Reference 1 is a 12 volt D.C. battery with sufficient amperage to provide power for an electric model starting motor, and also to provide 3.5 amperes (approximately), for igniting the electric glo plug.

Reference 2 is a momentary foot switch that can be controlled by the operator to provide power to the starting motor shown in 3.

Reference 3 is a 12 volt D.C. model starting motor that is activated when the foot switch shown in 2 is closed.

Reference 4 is a normally open, spring loaded set of contacts, of a two way switch provided for Test purposes only. The closing of this switch position 4, provides the operator with the opportunity for testing the glo plug circuit, prior to the starting procedure. This requires the connecting of the glo plug 8 located in the model engine to the leads from either the switch 6 or switch 7 to the ammeter 9. The spring loaded feature automatically opens this circuit when the switch handle is released after testing the flo plug circuit.

Reference 5 is a set of contacts on the two way switch, referred to as the operating position, which are closed manually by the operator when ready to start the motor.

Reference 6 is a set of momentary contacts on a hand switch, and 7 is a set of momentary contacts on a foot switch, which are connected in parallel, for the convenience of the operator. They are in series with 8, the glo plug, 9, the direct current ammeter, and 10, the 3 ohm current regulating resistor. The closing of 5, and either 6 or 7, provides a closed electrical, measured, and regulated circuit through the glo plug, from one pole of the battery, to the other pole. The wires connecting either switch 6 or switch 7 to the glo plug, and the wire connecting the other terminal of the glo plug 8 to the ammeter 9, are removed from the glo plug proper, as soon as the motor starts.

Reference 10 shows a resistor provided for the purpose of regulating the direct current amperes required by the glo plug shown in 8. Depending on the type and current requirements of the particular glo plug, and the output characteristics of the direct current battery, 1, this resistor 10, may be either a fixed resistor, or a variable resistor, or a combination of the two, as the current requirements dictate.

We claim:

1. An electrical circuit consisting of wiring and a direct current 12 volt D.C. battery of proper strength to provide sufficient voltage and amperage to a 12 volt D.C. starting motor, and a glo plug ignitor circuit, which is comprised of a glo plug, a direct current ammeter, and a 3 ohm resistor, and various switches, either current of which may be tested and operated independently of each other through use of momentary and spring loaded switches to provide operator control of the electric starting motor, and combustion circuits to the model engine.

* * * * *